US010431896B2

(12) United States Patent
Boryssenko et al.

(10) Patent No.: US 10,431,896 B2
(45) Date of Patent: Oct. 1, 2019

(54) MULTIBAND ANTENNA WITH PHASE-CENTER CO-ALLOCATED FEED

(71) Applicant: NUVOTRONICS, INC, Radford, VA (US)

(72) Inventors: Anatoliy Boryssenko, Belchertown, MA (US); Kenneth Vanhille, Cary, NC (US); Jennifer Arroyo, Arvada, CO (US)

(73) Assignee: CUBIC CORPORATION, San Diego, CA (US)

( * ) Notice: Subject to any disclaimer, the term of this patent is extended or adjusted under 35 U.S.C. 154(b) by 185 days.

(21) Appl. No.: 15/373,016

(22) Filed: Dec. 8, 2016

(65) Prior Publication Data

US 2018/0323510 A1 Nov. 8, 2018

Related U.S. Application Data

(60) Provisional application No. 62/268,054, filed on Dec. 16, 2015.

(51) Int. Cl.

| | |
|---|---|
| ***H01Q 5/00*** | (2015.01) |
| ***H01Q 13/18*** | (2006.01) |
| ***H01Q 21/00*** | (2006.01) |
| ***H01Q 5/47*** | (2015.01) |
| ***H01Q 5/50*** | (2015.01) |
| ***H01Q 5/35*** | (2015.01) |
| ***H01Q 21/06*** | (2006.01) |
| ***H01Q 21/28*** | (2006.01) |
| ***H01Q 5/40*** | (2015.01) |

(52) U.S. Cl.

CPC ..... *H01Q 13/18* (2013.01); *H01Q 5/35* (2015.01); *H01Q 5/40* (2015.01); *H01Q 5/47* (2015.01); *H01Q 5/50* (2015.01); *H01Q 21/0043* (2013.01); *H01Q 21/064* (2013.01); *H01Q 21/28* (2013.01)

(58) Field of Classification Search

CPC H01Q 13/18; H01Q 5/50; H01Q 5/35; H01Q 21/0043; H01Q 5/47

See application file for complete search history.

(56) References Cited

U.S. PATENT DOCUMENTS

| | | | |
|---|---|---|---|
| 3,157,847 | A | 11/1964 | Williams |
| 3,618,105 | A | 11/1971 | Bruene |
| 3,820,041 | A | 6/1974 | Gewartowski |
| 4,218,685 | A | 8/1980 | Frosch |
| 4,647,942 | A | 3/1987 | Counselman, III |
| 4,677,393 | A | 6/1987 | Sharma |

(Continued)

FOREIGN PATENT DOCUMENTS

| | | |
|---|---|---|
| WO | 2007076105 | 7/2007 |
| WO | 2014011675 | 1/2014 |

OTHER PUBLICATIONS

The ARRL Antenna Book, by Gerald Hall (Year: 1988).*

(Continued)

*Primary Examiner* — Hoang V Nguyen
*Assistant Examiner* — Awat M Salih
(74) *Attorney, Agent, or Firm* — Niels Haun; Dann, Dorfman, Herrell & Skillman

(57) ABSTRACT

Multiband antenna in the form of a three dimensional solid have a plurality of radiating cavities disposed therein.

18 Claims, 12 Drawing Sheets

(56) References Cited

U.S. PATENT DOCUMENTS

| | | | | |
|---|---|---|---|---|
| 4,994,817 | A * | 2/1991 | Munson | H01Q 13/18 343/746 |
| 5,557,291 | A | 9/1996 | Chu | |
| 6,101,705 | A | 8/2000 | Wolfson | |
| 6,317,099 | B1 | 11/2001 | Zimmerman | |
| 6,323,809 | B1 | 11/2001 | Maloney | |
| 6,356,241 | B1 | 3/2002 | Jaeger | |
| 6,512,487 | B1 | 1/2003 | Taylor | |
| 6,842,158 | B2 | 1/2005 | Jo | |
| 7,079,079 | B2 | 7/2006 | Jo | |
| 7,109,936 | B2 | 9/2006 | Mizoguchi | |
| 7,463,210 | B2 | 12/2008 | Rawnick | |
| 7,764,236 | B2 | 7/2010 | Hill | |
| 7,889,147 | B2 | 2/2011 | Tam | |
| 7,948,335 | B2 | 5/2011 | Sherrer | |
| 8,325,093 | B2 | 12/2012 | Holland | |
| 9,130,262 | B2 | 9/2015 | Park | |
| 10,008,779 | B2 | 6/2018 | Boryssenko | |
| 2003/0231134 | A1 | 12/2003 | Yarasi | |
| 2004/0263410 | A1 | 12/2004 | Teillet | |
| 2005/0013977 | A1 | 1/2005 | Wong | |
| 2005/0040994 | A1 | 2/2005 | Mazoki | |
| 2005/0116862 | A1 | 6/2005 | du Toit | |
| 2006/0232489 | A1 | 10/2006 | Bisiules | |
| 2007/0126651 | A1 | 6/2007 | Snyder | |
| 2008/0074339 | A1 | 3/2008 | Lee | |
| 2008/0079644 | A1 * | 4/2008 | Cheng | H01Q 13/10 343/769 |
| 2009/0051619 | A1 | 2/2009 | Hook | |
| 2009/0284419 | A1 | 11/2009 | Kim | |
| 2010/0007572 | A1 | 1/2010 | Jones | |
| 2011/0025574 | A1 | 2/2011 | Tiezzi | |
| 2011/0057852 | A1 | 3/2011 | Holland | |
| 2012/0146869 | A1 | 6/2012 | Holland | |
| 2013/0002501 | A1 | 1/2013 | Li | |
| 2013/0169505 | A1 | 7/2013 | Shmuel | |
| 2014/0103423 | A1 | 4/2014 | Ohlsson | |
| 2014/0354500 | A1 | 12/2014 | Tayama | |
| 2015/0162665 | A1 | 6/2015 | Boryssenko | |
| 2016/0268695 | A1 | 9/2016 | Zavrel, Jr. | |
| 2016/0370568 | A1 | 12/2016 | Toussaint | |
| 2017/0025767 | A1 | 1/2017 | Elsallal | |
| 2017/0256859 | A1 | 9/2017 | Boryssenko | |

OTHER PUBLICATIONS

Ghannoum, H. et al. "Probe Fed Stacked Patch Antenna for UWB Sectoral Applications," IEEE International Conference on Ultra-Wideband 2005. pp. 97-102.

A. Boryssenko, J. Arroyo, R. Reid, M.S. Heimbeck, "Substrate free G-band Vivaldi antenna array design, fabrication and testing" 2014 IEEE International Conference on Infrared, Millimeter, and Terahertz Waves, Tucson, Sep. 2014.

B. Cannon, K. Vanhille, "Microfabricated Dual-Polarized, W-band Antenna Architecture for Scalable Line Array Feed," 2015 IEEE Antenna and Propagation Symposium, Vancouver, Canada, Jul. 2015.

D. Filipovic, G. Potvin, D. Fontaine, C. Nichols, Z. Popovic, S. Rondineau, M. Lukic, K. Vanhille, Y. Saito, D. Sheffer, W. Wilkins, E. Daniels, E. Adler, and J. Evans, "Integrated micro-coaxial Ka-band antenna and array," GomacTech 2007 Conference, Mar. 2007.

E. Cullens, L. Ranzani, E. Grossman, Z. Popovic, "G-Band Frequency Steering Antenna Array Design and Measurements," Proceedings of the XXXth URSI General Assembly, Istanbul, Turkey, Aug. 2011.

Gao, S. et al. "A Broad-Band Dual-Polarized Microstrip Patch AntennaWith Aperture Coupling," IEEE Transactions on Antennas and Propagation, vol. 51, No. 4, Apr. 2003. pp. 898-900.

Gao, S.C., et al., "Dual-polarised Wideband Microstrip Antenna", Electronic Letters, Aug. 30, 2001, vol. 37, No. 18, pp. 1106-1107.

Guo, Y.X. et al. "L-probe proximity-fed short-circuited patch antennas," Electronics Letters, vol. 35 No. 24, Nov. 25, 1999. pp. 2069-2070.

H. Zhou, N. A. Sutton, D. S. Filipovic, "Surface micromachined millimeter-wave log-periodic dipole array antennas," IEEE Trans. Antennas Propag., Oct. 2012, vol. 60, No. 10, pp. 4573-4581.

H. Zhou, N. A. Sutton, D. S. Filipovic, "Wideband W-band patch antenna," 5th European Conference on Antennas and Propagation , Rome, Italy, Apr. 2011, pp. 1518-1521.

Holzheimer, et al., Performance Enhancements with Applications of the Coaxial Cavity Antenna, pp. 171-193.

Hsu, Wen-Hsiu et al. "Broadband Aperture-Coupled Shorted-Patch Antenna," Microwave and Optical Technology Letters, vol. 28, No. 5, Mar. 5, 2001. pp. 306-307.

J. M. Oliver, J.-M. Rollin, K. Vanhille, S. Raman, "A W-band micromachined 3-D cavity-backed patch antenna array with integrated diode detector," IEEE Trans. Microwave Theory Tech., Feb. 2012, vol. 60, No. 2, pp. 284-292.

J. M. Oliver, P. E. Ralston, E. Cullens, L. M. Ranzani, S. Raman, K. Vanhille, "A W-band Micro-coaxial Passive Monopulse Comparator Network with Integrated Cavity—Backed Patch Antenna Array," 2011 IEEE MTT-S Int. Microwave, Symp., Baltimore, MD, Jun. 2011.

J. Mruk, Z. Z Hongyu, M. Uhm, Y. Saito, D. Filipovic, "Wideband mm-Wave Log-Periodic Antennas," 3rd European Conference on Antennas and Propagation, pp. 2284-2287, Mar. 2009.

J. R. Mruk, N. Sutton, D. S. Filipovic, "Micro-coaxial fed 18 to 110 GHz planar log-periodic antennas with RF transitions," IEEE Trans. Antennas Propag., vol. 62, No. 2, Feb. 2014, pp. 968-972.

J.R. Mruk, Y. Saito, K. Kim, M. Radway, D. Filipovic, "A directly fed Ku- to W-band 2-arm Archimedean spiral antenna," Proc. 41st European Microwave Conf., Oct. 2011, pp. 539-542.

K. M. Lambert, F. A. Miranda, R. R. Romanofsky, T. E. Durham, K. J. Vanhille, "Antenna characterization for the Wideband Instrument for Snow Measurements (WISM)," 2015 IEEE Antenna and Propagation Symposium, Vancouver, Canada, Jul. 2015.

K. Vanhille, M. Lukic, S. Rondineau, D. Filipovic, and Z. Popovic, "Integrated micro-coaxial passive components for millimeter-wave antenna front ends," 2007 Antennas, Radar, and Wave Propagation Conference, May 2007.

L. Ranzani, N. Ehsan, Z. Popovi?????, "G-band frequency-scanned antenna arrays," 2010 IEEE APS-URSI International Symposium, Toronto, Canada, Jul. 2010.

M. Lukic, D. Fontaine, C. Nichols, D. Filipovic, "Surface micromachined Ka-band phased array antenna," Presented at Antenna Applic. Symposium, Monticello, IL, Sep. 2006.

M. Lukic, K. Kim, Y. Lee, Y. Saito, and D. S. Filipovic, "Multi-physics design and performance of a surface micromachined Ka-band cavity backed patch antenna," 2007 SBMO/IEEE Int. Microwave and Optoelectronics Conf., Oct. 2007, pp. 321-324.

M. V. Lukic, and D. S. Filipovic, "Integrated cavity-backed ka-band phased array antenna," Proc. IEEE-APS/URSI Symposium, Jun. 2007, pp. 133-135.

M. V. Lukic, and D. S. Filipovic, "Surface-micromachined dual Ka-and cavity backed patch antenna," IEEE Trans. Antennas Propag., vol. 55, No. 7, pp. 2107-2110, Jul. 2007.

Mruk, J.R., Saito, Y., Kim, K, Radway, M., Filipovic, D.S., "Directly fed millimetre-wave two-arm spiral antenna," Electronics Letters, Nov. 25, 2010, vol. 46 , issue 24, pp. 1585-1587.

N. Chamberlain, M. Sanchez Barbetty, G. Sadowy, E. Long, K. Vanhille, "A dual-polarized metal patch antenna element for phased array applications," 2014 IEEE Antenna and Propagation Symposium, Memphis, Jul. 2014. pp. 1640-1641.

N. Jastram, D. S. Filipovic, "Parameter study and design of W-band micromachined tapered slot antenna," Proc. IEEE-APS/URSI Symposium, Orlando, FL, Jul. 2013, pp. 434-435.

N. Sutton, D.S. Filipovic, "Design of a K- thru Ka-band modified Butler matrix feed for a 4-arm spiral antenna," 2010 Loughborough Antennas and Propagation Conference, Loughborough, UK, Nov. 2010, pp. 521-524.

N.A. Sutton, D. S. Filipovic, "V-band monolithically integrated four-arm spiral antenna and beamforming network," Proc. IEEE-APS/URSI Symposium, Chicago, IL, Jul. 2012, pp. 1-2.

(56) References Cited

OTHER PUBLICATIONS

Nakano, M., et al., "Feed Circuits of Double-Layered Self-Diplexing Antenna for Mobile Satelite Communications", Transactions on Antennas and Propagation, vol. 40, No. 1, Oct. 1992, pp. 1269-1271.
Oliver, J.M. et al., "A 3-D micromachined W-band cavity backed patch antenna array with integrated rectacoax transition to wave guide," 2009 Proc. IEEE International Microwave Symposium, Boston, MA 2009.
Sevskiy, S. and Wiesbeck, W., "Air-Filled Stacked-Patch Antenna," ITG-Fachberichte. No. 178, (2003). pp. 53-56.
T. E. Durham, C. Trent, K. Vanhille, K. M. Lambert, F. A. Miranda, "Design of an 8-40 GHz Antenna for the Wideband Instrument for Snow Measurements (WISM)," 2015 IEEE Antenna and Propagation Symposium, Vancouver, Canada, Jul. 2015.
Tim Holzheimer, Ph.D., P .E., The Low Dispersion Coaxial Cavity as an Ultra Wideband Antenna, 2002 IEEE Conference on Ultra Wideband Systems and Technologies, pp. 333-336.
Vallecchi, A. et al. "Dual-Polarized Linear Series-Fed Microstrip ArraysWith Very Low Losses and Cross Polarization," IEEE Antennas and Wireless Propagation Letter, vol. 3, 2004. pp. 123-126.
Y. Saito, J.R. Mruk, J.-M. Rollin, D.S. Filipovic, "X- through Q-band log-periodic antenna with monolithically integrated u-coaxial impedance transformer/feeder," Electronic Letts. Jul. 2009, pp. 775-776.
Y. Saito, M.V. Lukic, D. Fontaine, J.-M. Rollin, D.S. Filipovic, "Monolithically Integrated Corporate-Fed Cavity-Backed Antennas," IEEE Trans. Antennas Propag., vol. 57, No. 9, Sep. 2009, pp. 2583-2590.
Z. Popovic, "Micro-coaxial micro-fabricated feeds for phased array antennas," in IEEE Int. Symp. on Phased Array Systems and Technology, Waltham, MA, Oct. 2010, pp. 1-10. (Invited).
Zurcher, J. "Broadband Patch Antennas," Chapter 3, 1995. pp. 45-61.
J. D. Dyson, "The equiangular spiral antenna," Wright Air Development Center, 1957.
Justin A. Kasemodel, et al.; A Novel Non-Symmetric Tightly Coupled Element for Wideband Phased Array Apertures; Dissertation The Ohio State University; 2010; pp. 1-13.
Markus H. Novak, et al.; Ultra-Wideband Phased Array Antennas for Satellite Communications up to Ku- and Ka-Band; May 2015; pp. 1-6.
Wajih Elsallal, et al.; Charateristics of Decade-bandwidth, Balanced Antipodal Vivaldi Antenna (BAVA) Phased Arrays with Time-Delay Beamformer Systems; IEEE International Symposium on Phased Array Systems and Technology.
Michel Arts, et al.; Broadband Differentially Fed Tapered Slot Antenna Array for Radio Astronomy Applications; 2009; 3rd European Conference on Antennas and Propagation; pp. 1-5.
Yongwei Zhang, et al.; Octagonal Ring Antenna for a Compact Dual-Polarized Aperture Array; IEEE Transactions on Antennas and Propagation, vol. 59, No. 10, Oct. 2011; pp. 3927-3932.
Hisao Iwasaki, et al.; A Circularly Polarized Microstrip ANfENNA Using Singly-FED Proximity CCUPLED Feed; Proceedings of ISAP '92, Sapporo, Japan; pp. 797-800.
Hansen, Robert C. Phased array antennas. vol. 213. John Wiley & Sons, 2009.
Herd, J., and S. Duffy. "Overlapped digital subarray architecture for multiple beam phased array radar." Proceedings of the 5th European Conference on Antennas and Propagation (EUCAP). IEEE, 2011.
L. Ranzani, D. Kuester, K. J. Vanhille, A. Boryssenko, E. Grossman and Z. Popovic, "G-band Micro-fabricated Frequency-steered Arrays with 2deg/GHz Beam Steering," IEEE Transactions on Terahertz Science and Technology, vol. 3, No. 5, Sep. 2013.
Kindt, Rick W., and W. Raymond Pickles. All-Metal Flared-Notch Array Radiator for Ultrawideband Applications. No. NRL/MR/5310-10-9279. Naval Research Lab Washington DC Radar Analysis Branch, 2010.
Doane, Jonathan P., Kubilay Sertel, and John L Volakis. "A wideband, wide scanning tightly coupled dipole array with integrated balun (TCDA-IB)." IEEE Transactions on Antennas and Propagation 61.9 (2013): 4538-4548.
Moulder, William F., Kubilay Sertel, and John L. Volakis. "Superstrate-enhanced ultrawideband tightly coupled array with resistive FSS." IEEE Transactions on Antennas and Propagation 60.9 (2012): 4166-4172.
Papantonis, Dimitrios K, and John L. Volakis. "Dual-polarization TCDA-IB with substrate loading." 2014 IEEE Antennas and Propagation Society International Symposium (APSURSI). IEEE, 2014.
Herd, J., et al. "Multifunction Phased Array Radar (MPAR) for aircraft and weather surveillance." 2010 IEEE Radar Conference. IEEE, 2010.
Ben Munk et al.; "A Low-Profile Broadband Phased Array Antenna"; The Ohio State University ElectroScience Laboratory, Dept. of Electrical Engineering; 2003 pp. 448-451.
Woorim Shin, et al. "A 108-114 GHz 4 4 Wafer-Scale Phased Array Transmitter With High-Efficiency On-Chip Antennas"; IEEE Journal of Solid-State Circuits, vol. 48, No. 9, Sep. 2011.
Harold A. Wheeler; "Simple Relations Derived from a Phased-Array Antenna Made of an Infinite Current Sheet"; IEEE Transactions on Antennas Propagation; Jul. 1965; pp. 506-514.
E. G. Magill, et al.; Wide-Angle Impedance Matching of a Planar Array Antenna by a Dielectric Sheet; IEEE Transactions on Antennas Propagation; Jan. 1966; vol. AP-14 No. 1; pp. 49-53.
P. W. Hannan, et al.; Impedance Matching a Phased-Array Antenna Over Wide Scan Angles by Connecting Circuits; Impedance Matching a Phased-Array Antenna; Jan. 1965 pp. 28-34.
James E. Dudgeon, et al.;Microstrip Technology and Its Application to Phased Array Compensation; Jan. 21, 1972; pp. 1-81.
Kerry Speed, et al; Progress on the 8-40 GHz Wideband Instrument for Snow Measurements(WISM); Harris.com Earth Science Tech nology Forum Oct. 28-30, 2014 2014 Leesburg, VA; pp. 1-36.
Mark Jones, et al.; A New Approach to Broadband Array Design Using Tightly Coupled Elements; IEEE; 2007; pp. 1-7.
W. M. Qureshi et al., Fabrication of a Multi-Octave Phased Array Aperture; 6th EMRS DTC Technical Conference—Edinburgh; 2009; pp. 1-5.
John Forrest McCann, B.S.; On the Design of Large Bandwidth Arrays of Slot Elements With Wide Scan Angle Capabilities; Thesis The Ohio State University; 2006; pp. 1-102.
Tengfei Xia et al.; Design of a Tapered Balun for Broadband Arrays With Closely Spaced Elements; IEEE Antennas and Wireless Propagation Letters, vol. 8, 2009; pp. 1291-1294.
Justin A. Kasemodel, et al.; A Miniaturization Technique for Wideband Tightly Coupled Phased Arrays; IEEE; 2009; pp. 1-4.
Elias A. Alwan Et al.; A Simple Equivalent CircuitModel for Ultrawideband Coupled Arrays; IEEE Antennas and Wireless Propagation Letters, vol. 11, 2012; pp. 117-120.
Nathanael J. Smith; Development of a 180° Hybrid Balun to Feed a Tightly Coupled Dipole X-Band Array; The Ohio State University 2010; pp. 1-52.
Justin A. Kasemodel; Realization of a Planar Low-Profile Broadband Phased Array Antenna; Dissertation, The Ohio State University 2010; pp. 1-120.
Justin A. Kasemodel, et al.; Low-Cost, Planar and Wideband Phased Array with Integrated Balun and Matching Network for Wide-Angle Scanning; IEEE 2010; pp. 2-4.
Erdinc Irci; Low-Profile Wideband Antennas Based on Tightly Coupled Dipole and Patch Elements; Dissertation, The Ohio State University 2011; pp. 1-126.
William F. Moulder; Novel Implementations of Ultrawideband Tightly Coupled Antenna Arrays: Dissertation, The Ohio State University 2012; pp. 1-133.
Ioannis Tzanidis; Ultrawideband Low-Profile Arrays of Tightly Coupled Antenna Elements: Excitation, Termination and Feeding Methods; Dissertation, The Ohio State University 2011; pp. 1-189.
Jonathan Doane; Wideband Low-Prole Antenna Arrays: Fundamental Limits and Practical Implementations; Disseration, The Ohio State University 2013; pp. 1-265.

(56) References Cited

OTHER PUBLICATIONS

Justin A. Kasemodel et al.; Wideband Planar Array With Integrated Feed and Matching Network for Wide-Angle Scanning; IEEE Transactions on Antennas and Propagation, vol. 61, No. 9, Sep. 2013; pp. 4528-4537.
Jonathan P. Doane, et al.; Wideband, Wide Scanning Conformal Arrays with Practical Integrated Feeds; Proceedings of the "2013 International Symposium on Electromagnetic Theory"; pp. 859-862.
Steven S. Holland, et al.; Design and Fabrication of Low-Cost PUMA Arrays; IEEE; 2011; pp. 1976-1979.
Steven S. Holland; Low-Profile, Modular, Ultra-Wideband Phased Arrays; Dissertation, University of Massachusetts; Sep. 2011; pp. 1-327.
John T. Logan, et al.; A Review of Planar Ultrawideband Modular Antenna (PUMA) Arrays; Proceedings of the "2013 International Symposium on Electromagnetic Theory"; 2013; pp. 868-871.
D. Cavallo, et al.; Common-Mode Resonances in Ultra Wide Band Connected Arrays of Dipoles: Measurements from the Demonstrator and Exit Strategy; IEEE; 2009; pp. 435-438.
J. J. Lee, et al.; Performance of a Wideband (3-14 GHz) Dual-pol Array; IEEE; 2004; pp. 551-554.
Jian Bai, et al.; Ultra-wideband Slot-loaded Antipodal Vivaldi Antenna Array; IEEE; 2011; pp. 79-81.
E. Garca I, et al.; Elimination of Scan Impedance Anomalies in Ultra-Wide Band Phased Arrays of Differentially Fed Tapered Slot Antenna Elements; IEEE; 2008; pp. 1-4.
Eloy de Lera Acedo, et al.; Study and Design of a Differentially-Fed Tapered Slot Antenna Array; IEEE Transactions on Antennas and Propagation, vol. 58, No. 1, Jan. 2010; pp. 68-78.
Y. Chen, et al.; A Novel Wideband Antenna Array With Tightly Coupled Octagonal Ring Elements; Progress in Electromagnetics Research, vol. 124, 55-70; 2012.
J. Y. Li; Design of Broadband Compact Size Antenna Comprised of Printed Planar Dipole Pairs; Progress in Electromagnetics Research Letters, vol. 12, 99-109; 2009.
Mats Gustafsson; Broadband array antennas using a self-complementary antenna array and dielectric slabs; CODEN: LUTEDX/(TEAT-7129)/1-8; Dec. 13, 2004.
Terry Richard Vogler; Analysis of the Radiation Mechanisms in and Design of Tightly-Coupled Antenna Arrays; Dissertation, Virginia Polytechnic Institute and State University; Sep. 10, 2010; pp. 1-251.
S. G. Hay, et al.; Analysis of common-mode effects in a dual-polarized planar connected-array antenna; Radio Science, vol. 43, RS6S04, doi:10.1029/2007RS003798; 2008.
A. Chippendale et al.; Chequerboard Phased Array Feed Testing for ASKAP; May 3, 2010; pp. 1-41.
Yan Fei, et al.; A Simple Wideband Dual-Polarized Array With Connected Elements; University of Electronic Science and Technology of China (UESTC); 2013; pp. 1-21.
Fei Yan, et al. ; A Simple Wideband Dual-Polarized Array With Connected Elements; Institute of Applied Physics and Computational Mathematics; 978-1-4673-5317-5/13 2013 IEEE.
Tomasz Michna, et al.; Characterization of an Impulse-Transmitting UWB Antenna Array with Dispersive Feed Network; Characterization of an Impulse-Transmitting UWB; 2008; pp. 59-62. Antenna Array with Dispersive Feed Network.
Martin Wagner, et al.; Multi -B and Polarization-Ver satile Array Antenna for Smart Antenna Applications in Cellular Systems; 2004 EEE MH-S Digest; pp. 1769-1772.
Jeremie Bourqui, et al.; Balanced Antipodal Vivaldi Antenna With Dielectric Director for Near-Field Microwave Imaging; EEE Transactions on Antennas and Propagation, vol. 58, No. 7; Jul. 2010.
R.N. Simons, et al.; Impedance matching of tapered slot antenna using a dielectric transformer; Electronics Letters Nov. 26, 1998 vol. 34 No. 24.
S. A. Adamu, et al.; Review on Gain and Directivity Enhancement Techniques of Vivaldi Antennas; International Journal of Scientific & Engineering Research, vol. 8, Issue 3, Mar. 2017; ISSN 2229-5518.
S. Livingston, et al.; Evolution of Wide Band Array Designs; 2011; IEEE pp. 1957-1960.
J. J. Lee,W et al.; Wide Band Long Slot Array Antennas; IEEE; 2003; pp. 452-455.
Johnson J. H. Wang; A New Planar Multioctave Broadband Traveling-Wave Beam-Scan Array Antenna; Wang Electro-Opto Corporation; 2007; pp. 1-4.
John Toon; New planar design allows fabrication of ultra-wideband, phased-array antennas; 100-to-1 Bandwidth @ Winter 2006; pp. 18-19.
Hans Steyskal, et al.; Design of Realistic Phased Array Patch Elements Using a Genetic Algorithm; Air Force Research Laboratory; 2010; pp. 246-252.
Benjamin Riviere, et al.; Ultrawideband Multilayer Printed Antenna Arrays With Wide Scanning Capability; 2015; IEEE; 514-515.
Boryssenko, et al.; A Matlab Based Universal CEM CAD Optimizer; 2012; IEEE International Symposium on Antennas and Propagation; pp. 1-25.
Frank B. Gross; Ultra-wideband antenna arrays—The basics—Part I; Apr. 7, 2011.

* cited by examiner

MULTIBAND ANTENNA WITH PHASE-CENTER CO-ALLOCATED FEED

RELATED APPLICATIONS

This application claims the benefit of priority of U.S. Provisional Application No. 62/268,054, filed on Dec. 16, 2015, the entire contents of which application(s) are incorporated herein by reference.

GOVERNMENT LICENSE RIGHTS

This invention was made with government support under contract #NNX15CP66P awarded by National Aeronautics and Space Administration (NASA). The government has certain rights in the invention.

FIELD OF THE INVENTION

The present invention relates generally to antennas, and more particularly but not exclusively to multiband antennas structured as a three dimensional solid having a plurality of radiating cavities disposed therein.

BACKGROUND OF THE INVENTION

A variety of applications exist with a need to feed a single reflector antenna to operate across multiple sub-bands disposed within a bandwidth. Typically such sub-bands are relatively narrowband. For example, many NASA airborne and space science applications have to support multiple electromagnetic sensor instruments that operate through the same shared reflector apertures. The applications may involve, but are not limited to measurements of aerosols, clouds, precipitation, snow water equivalent and wind velocities. Such instruments can include radiometers, active radar devices and scatterometers, and even can be combined with a communication link. Alternatively, the same aperture sharing approach can be used for multiband communication and so on.

Feeds of shared reflectors can be made using a number of horn antennas, viz. one horn for each sub-band. However, only one horn can be in the reflector focus for optimal illumination of the reflector surface. The remaining horns will be off focus and, thus, cannot provide optimal illumination of the reflector surface. Furthermore, the remaining horns may introduce blockage of the reflector. Alternatively, antennas comprising stacked patches using multi-layer circuit boards may also be designed to perform similar functions as reflector feeds; however, the phase center normal to the patch surfaces of such antennas differ depending on which patch is radiating, which may change depending on the frequency bands of operation. The proposed antenna does not suffer from such detuning of the reflector antenna optics over frequency.

Another approach is to employ a broadband array that allows operation on multiple sub-bands with an optimal reflector excitation, because the array feed can be installed in the focus. However, using a broadband array to feed a reflector is not straightforward, because such arrays can operate truly in broadband mode only if they are (1) electrically large and (2) fully excited. A typical array used to feed reflectors can be small to avoid blockage of the reflector. At the same time, small arrays may suffer from edge truncation and severe impedance mismatching. Another factor degrading impedance matching of feed arrays is fragmented excitation, when only a part of array is selectively used to drive particular bands of interest and, thus, those arrays are not fully excited.

SUMMARY OF THE INVENTION

In one of its aspects, the present invention provides a multiband antenna in which at least two cavities are present, each dimensioned and configured differently according to the operational wavelength at which the respective cavity is to operate. A first, inner cavity may operate at a first, relatively-higher frequency, while a second cavity may operate at a relatively lower frequency. Each cavity may be excited by two probes from opposite locations which may be differentially fed by a network of feedlines. The feedline network may be provided in a metal base of the multiband feed and may include vertical and horizontal feed network distribution sections. Each cavity may include its own feed network routed inside the body of the antenna. The feedline for each cavity may start at the bottom of the feed structure where, for example, a connector can be placed. The feedline may ascend vertically and then split into two differentially-fed branches using an integrated narrow-band balun or other power divider circuit. Each differentially-fed branch may be routed through several vertical-horizontal paths until reaching a designated cavity, where it may terminate in an open cavity section to excite the cavity.

For example, in one exemplary configuration, the present invention may provide a multiband antenna for operation at two or more selected wavelengths. The multiband antenna may include a first cavity having first sidewalls disposed within the antenna. The first sidewalls may extend upward from the interior of the antenna to an upper surface of the antenna such that the first sidewalls provide a first aperture in the upper surface having an annular shape. A second cavity having second sidewalls may be disposed within the antenna, and the second sidewalls may extend upward from the interior of the antenna to the upper surface of the antenna such that the second sidewalls provide a second aperture in the upper surface having an annular shape. The second aperture may be disposed internally to the first aperture within the upper surface. A first pair of excitation probes may be disposed within the first cavity to drive the cavity. The first pair of excitation probes may each have a length associated therewith, and the difference between the lengths of the probes of the first pair may be one half of a selected operational wavelength. In addition, a second pair of excitation probes may be disposed within the second cavity. The second pair of excitation probes may each have a length associated therewith, and the difference between the lengths of the probes of the second pair may be one half of a second selected operational wavelength. The first cavity may extend from the upper surface into the antenna to a depth which is greater than that of the second cavity.

In a second exemplary configuration, the present invention may provide a multiband antenna for operation at two or more selected wavelengths having a first pair of cavities. The first pair of cavities may include first sidewalls disposed within the antenna, with the first sidewalls extending upward from the interior of the antenna to an upper surface of the antenna such that the first sidewalls provide a first pair of apertures having a rectangular shape in the upper surface. The antenna may also include a second pair of cavities each having second sidewalls disposed within the antenna, with the second sidewalls extending upward from the interior of the antenna to the upper surface of the antenna such that the second sidewalls provide a second pair of apertures having a rectangular shape in the upper surface. The first and second pairs of apertures may each disposed symmetrically on opposing sides of a central line disposed parallel to the longitudinal axes of the apertures, and the antenna may include a first pair of excitation probes disposed within the first pair of cavities.

BRIEF DESCRIPTION OF THE DRAWINGS

The foregoing summary and the following detailed description of exemplary embodiments of the present invention may be further understood when read in conjunction with the appended drawings, in which.

DETAILED DESCRIPTION OF THE INVENTION

In one of its aspects, multiband antennas of the present invention may be operable at two or more wavelengths simultaneously by providing a separate radiating cavity for each band at which the antenna is to function. The cavities may be formed in an electrically conductive, e.g., metal base, which may be created by an additive build process, such as that described in U.S. Pat. Nos. 7,012,489, 7,649,432, 7,948,335, 7,148,772, 7,405,638, 7,656,256, 7,755,174, 7,898,356, 8,031,037, 2008/0199656, 2011/0123783, 2010/0296252, 2011/0273241, 2011/0181376, 2011/0210807, the contents of which are incorporated herein by reference.

Each cavity may be dimensioned and configured with regard to the particular operational wavelength the cavity is designed to support. Thus, in a multiband antenna at least two cavities are present, each dimensioned and configured differently according to the operational wavelength at which the respective cavity is to operate. For example, a first cavity of first dimensions may operate at a first frequency, while a second cavity having relatively larger dimensions may operate at a relatively lower frequency (longer wavelength). Each cavity may be excited by two probes from opposite locations which may be differentially fed. It should be appreciated, that while antennas of the present invention may be described as operating in a transmitting/radiating mode, the multiband antennas of the present invention may also operate in a reception mode to receive electromagnetic radiation. Moreover, some cavities may be operating in a radiating mode while others are operating in a reception mode.

Figure 1:
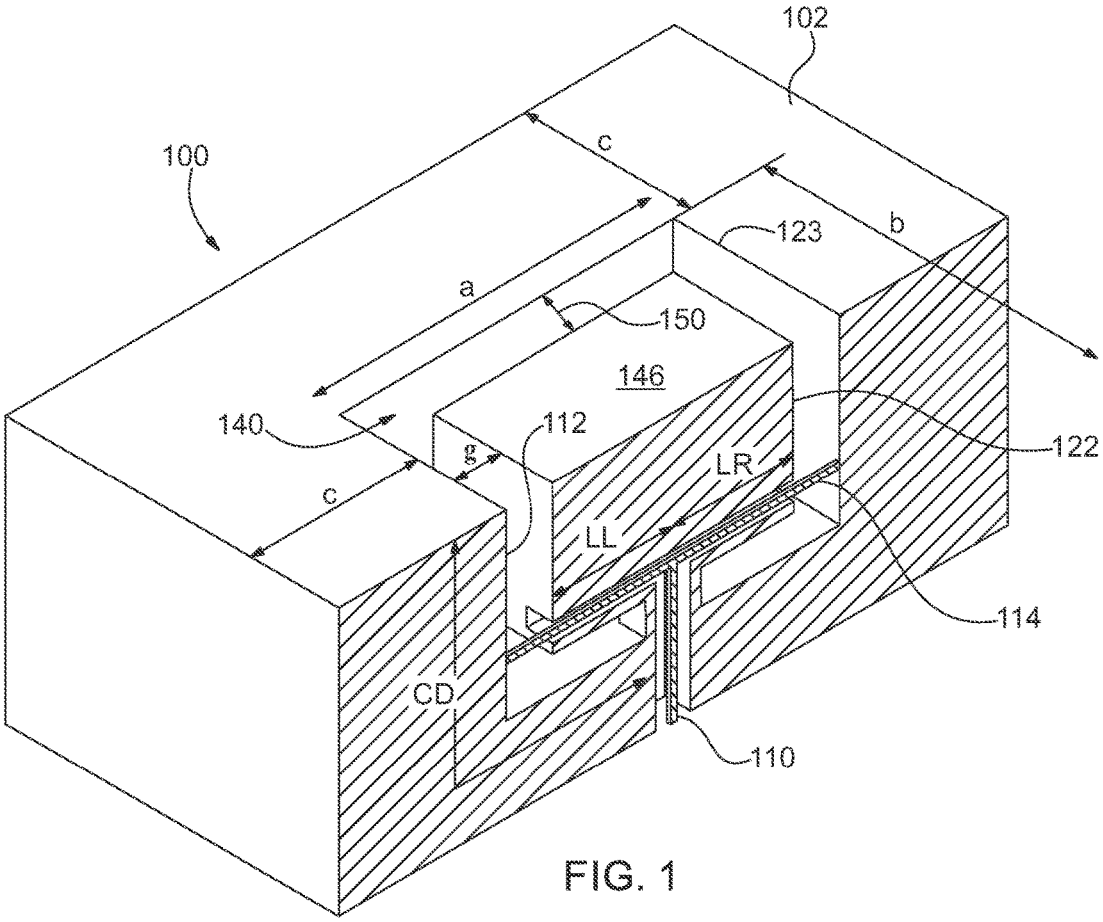
FIG. 1 schematically illustrates an isometric, cross-sectional view of an exemplary configuration of a single-band antenna showing various features and aspects related to multiband antennas of the present invention.

Referring now to the figures, wherein like elements are numbered alike throughout. FIG. 1 schematically illustrates an isometric, cross-sectional view of an exemplary configuration of a single-band antenna 100, which demonstrates various features found in multiband antennas of the present invention. The single-band antenna 100 may include a cavity 140 having interior sidewalls 122 and exterior sidewalls 123 disposed within the antenna 100. The interior and exterior sidewalls 122, 123 may extend upward from the interior of the antenna 100 to an upper surface 102 of the antenna 100 such that the sidewalls 122, 123 provide an aperture 150 having an annular shape in the upper surface 102. An island 146 may be provided internally to the interior sidewalls 122. Aperture 150 may have a generally square or rectangular shape having a first dimension "a" and a second dimension "b", and may have a gap width labeled "g". Additionally, aperture 150 may have a circular or elliptical shape or the annular slots may be meandered in the plane of 122 to increase its electrical length and give more control over operational bands. The aperture dimensions "a" and "b" may desirably be in the range of a fraction of an operational wavelength at which the cavity 140 is designed to operate, to help deter higher order coaxial modes. The gap may desirably be very small; for example, "g" may be 1/10 to 1/100 of the operational wavelength. In addition, the aperture 150 may be offset from an edge of the antenna 100 by a distance "c". In addition, just as it may be desirable to have the aperture dimensions "a" and "b" be different, it may also be desirable to have a different set of offsets "c" and "d" from the edge of the antenna. Alternatively, the co-located annular slots may be mounted on a larger body such as a vehicular platform or in an environment that closely approximates an infinite ground plane in antenna parlance.

The cavity 140 may be driven by first and second excitation probes 112, 114 which may be disposed at opposing locations within the cavity 140. (The probes 112, 114 may alternatively operate as receivers rather than transmitters.) The excitation probes 112, 114 may be fed by a common feedline 110 in a "T" configuration. The excitation probes 112, 114 and feedline 110 may extend through the volume of the antenna 100 and island 146 in the form of coaxial transmission lines. Other types of transmission lines, such as a stripline in a printed circuit board may be used. In addition, the excitation probes 112, 114 may desirably differ in length by one half of the operational wavelength; that is, there may be an electrical length difference of pi (180°) between the probes 112, 114. In particular, the dimensions "LL" and "LR" may differ by half of the operational wavelength to differentially drive the cavity 140. Alternatively, this phase difference may be created using 180-degree hybrids (e.g., a rat-race hybrid), by using a balun (e.g., a Marchand balun) or by feeding one of the two excitation probes from the exterior side wall, 123, to interior side wall, 122, rather than what is shown. The cavity depth "CD" may desirably be approximately one quarter of the operational wavelength and may be meandered as shown in FIG. 1. A cavity is considered meandered as used herein when the cavity depth does not extend along a single linear dimension, which may be desirable to help save space. For instance as shown in FIG. 1 the cavity 140 is meandered in an "L" shape.

Figure 2A:
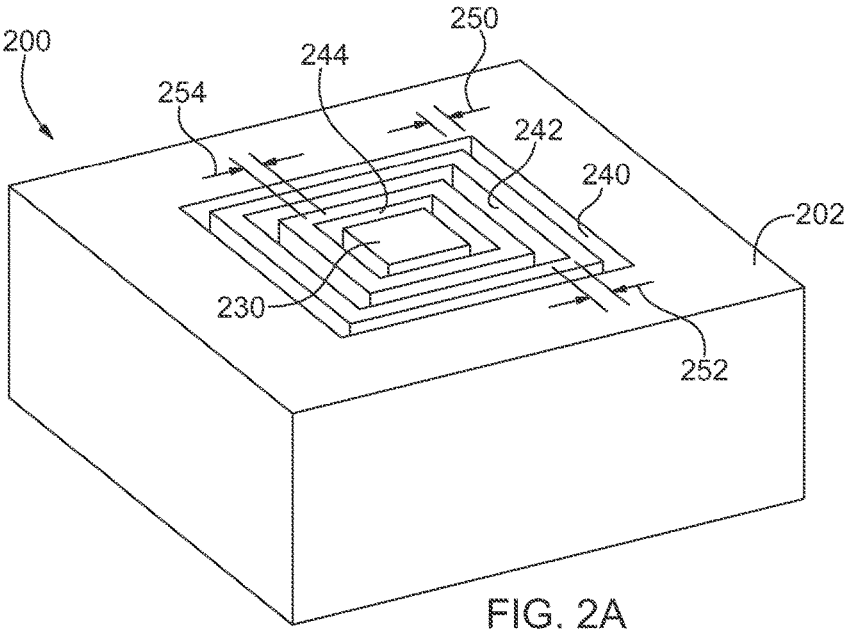
FIGS. 2A, 2B schematically illustrate isometric and isometric, cross-sectional views, respectively, of an exemplary configuration of a multiband antenna in accordance with the present invention.
Figure 2B:
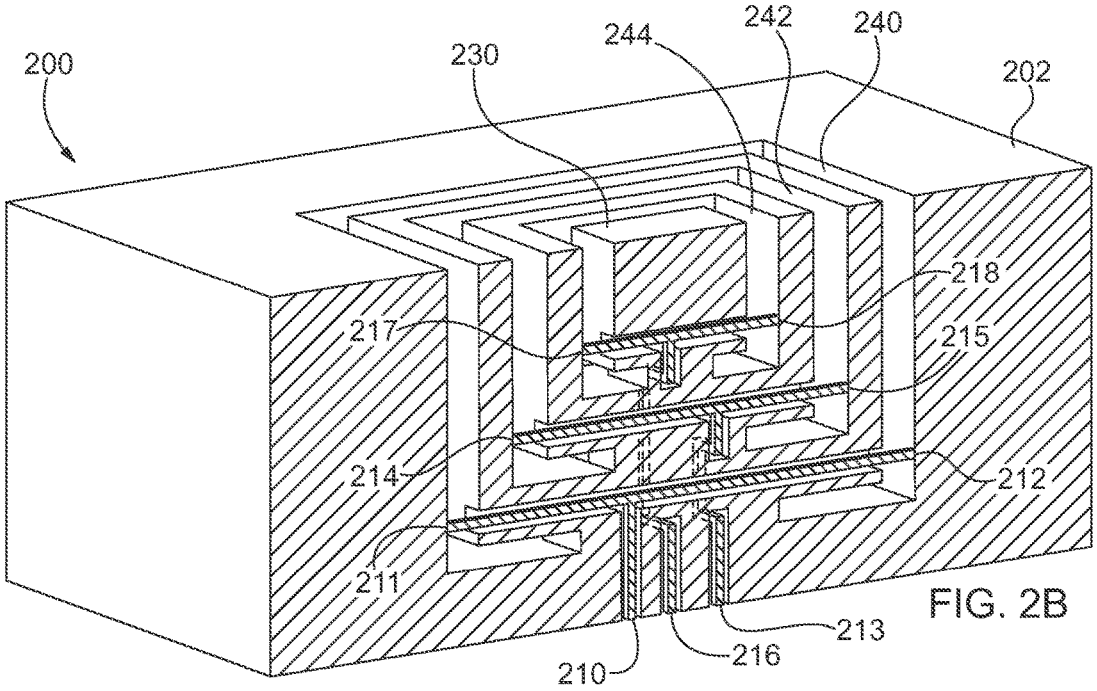
Figure 2C:
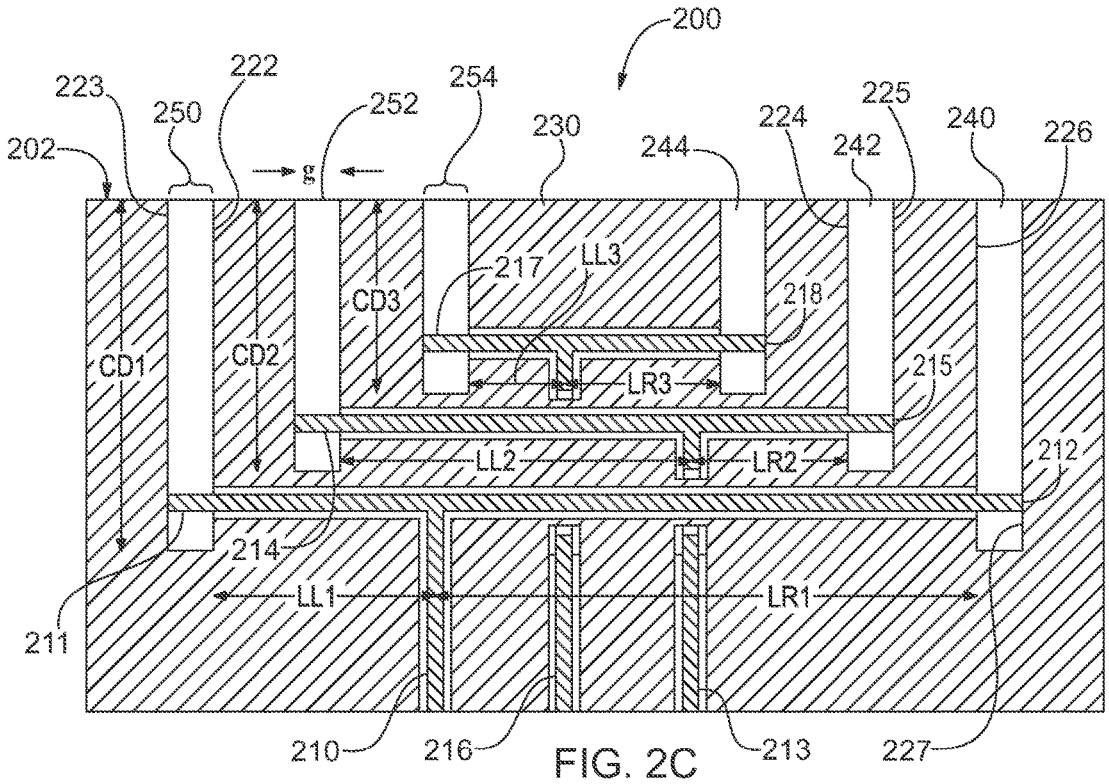
FIG. 2C schematically illustrates a side elevational with dimensioning lines of the cross-section of FIG. 2B.

Turning then to multiband antennas in accordance with the present invention, FIGS. 2A-2C schematically illustrate an exemplary configuration of a multiband (e.g., triple band) antenna 200 in accordance with the present invention. The antenna 200 may include three cavities 240, 242, 244 each having respective interior sidewalls 222, 224, 226 and exterior sidewalls 223, 225, 227 disposed within the antenna 200 to provide triple band operation. The outermost cavity 240 of a larger depth "CD1" may be used to operate at a lower operational frequency, $F_{min}$. The innermost cavity 244 of lesser depth "CD3" may be used to operate at a higher operational frequency, $F_{max}$, FIG. 2C. One or more intermediate cavities 242 of intermediate depth "CD2" may be used to operate at other frequencies between $F_{min}$ and $F_{max}$. An island 230 may be provided interior to the innermost cavity 244. The interior and exterior sidewalls 222-227 may extend upward from the interior of the antenna 200 to an upper surface 202 of the antenna 200 such that the gap between adjacent sidewalls 222-227 provide respective apertures 250, 252, 254 having annular shapes in the upper surface 202, FIGS. 2B, 2C.

The apertures 250, 252, 254 may have a generally square or rectangular shape and may have a gap width labeled "g". Alternatively, the apertures 250, 252, 254 may have any shape suitable for radiating or receiving electromagnetic radiation at a desired operational wavelength, such as circular or meandered. Dimensions may be set as exemplified with the single-band antenna 100 of FIG. 1, such as the aperture dimensions "a", "b". The gap may desirably be very small, for example "g" may be 1/10 to 1/100 of the operational wavelength.

Figure 3:
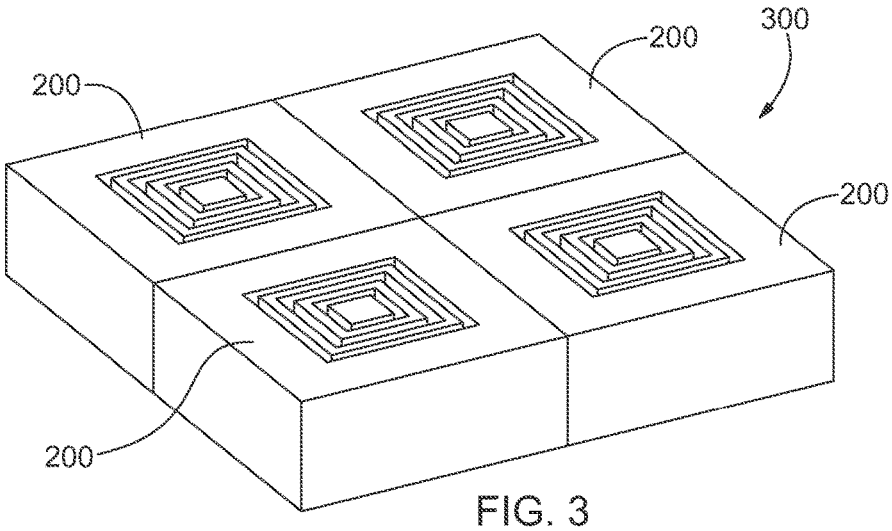
FIG. 3 schematically illustrates a 2×2 array of multiband antennas in accordance with the present invention.

The cavities 240, 242, 244 may be driven by respective pairs of excitation probes 211/212, 214/215, 217/218, a given pair of which may be disposed on opposing locations within the respective cavity 240, 242, 244. (The probes 211/212, 214/215, 217/218 may alternatively operate as receivers rather than transmitters.) Each probe pair 211/212, 214/215, 217/218 may be fed by a respective feedline 210, 213, 216 in a "T" configuration, FIGS. 2B, 2C. The excitation probes 211/212, 214/215, 217/218 and feedlines 210, 213, 216 may extend through the volume of the antenna 200 and island 230 in the form of coaxial transmission lines. In addition, each pair of probes 211/212, 214/215, 217/218 may desirably differ in length by one half of the operational wavelength, i.e., an electrical length difference of pi (180°). Thus, the dimensions "LL1" and "LR1" may differ by half of the operational wavelength of the cavity 240 to differentially drive the cavity 240. Similarly, "LL2"/"LR2" and "LL3"/"LR3" may differ by half of the operational wavelength of their respective cavity 242, 244. The cavity depths "CD1", "CD2", "CD3" may be approximately one quarter of the operational wavelength and may be non-meandered as shown in FIG. 2C, or meandered as shown in FIG. 1. Additionally, in FIG. 3 an array 300 of antennas 200 may be provided for applications in which an antenna array is preferred.

Figure 4:
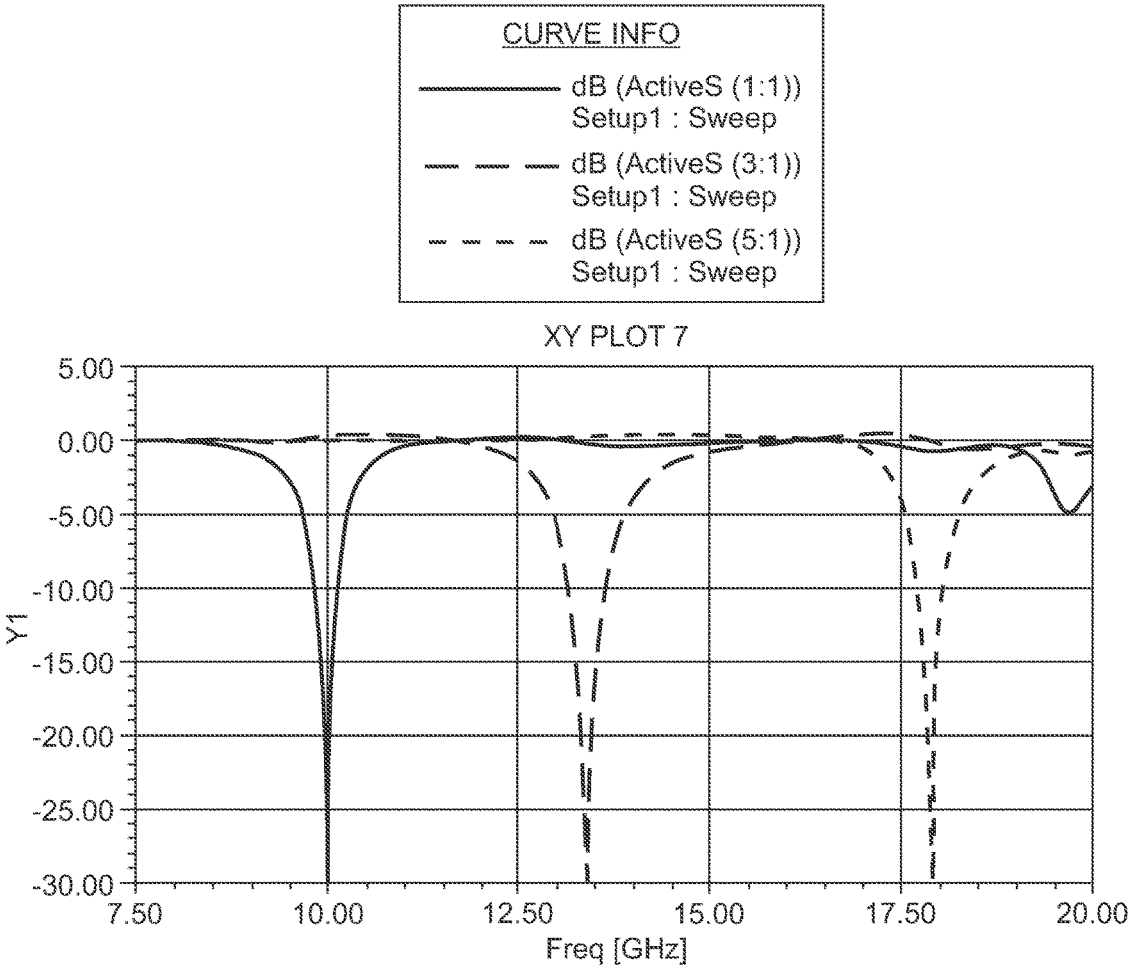
FIG. 4 illustrates the theoretical active input reflection coefficients for a 3-band version of the multiband antenna tuned to operate at an X-band frequency around 10 GHz, a Ku-band frequency around 13.5 GHz, and a lower K-band frequency around 18 GHz.
Figure 5:
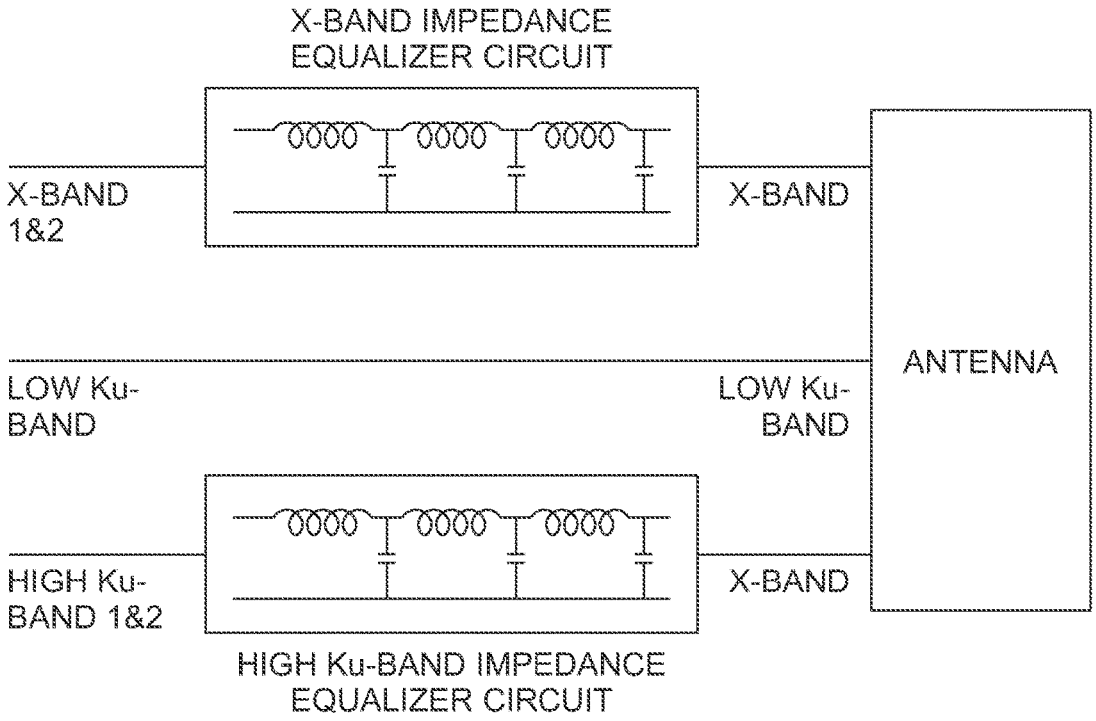
FIG. 5 schematically illustrates an exemplary configuration of a circuit in accordance with the present invention that may be used to drive multiband antennas of the present invention, in which the lowest X band and highest K-band frequencies are each split into two sub-bands.
Figure 6:
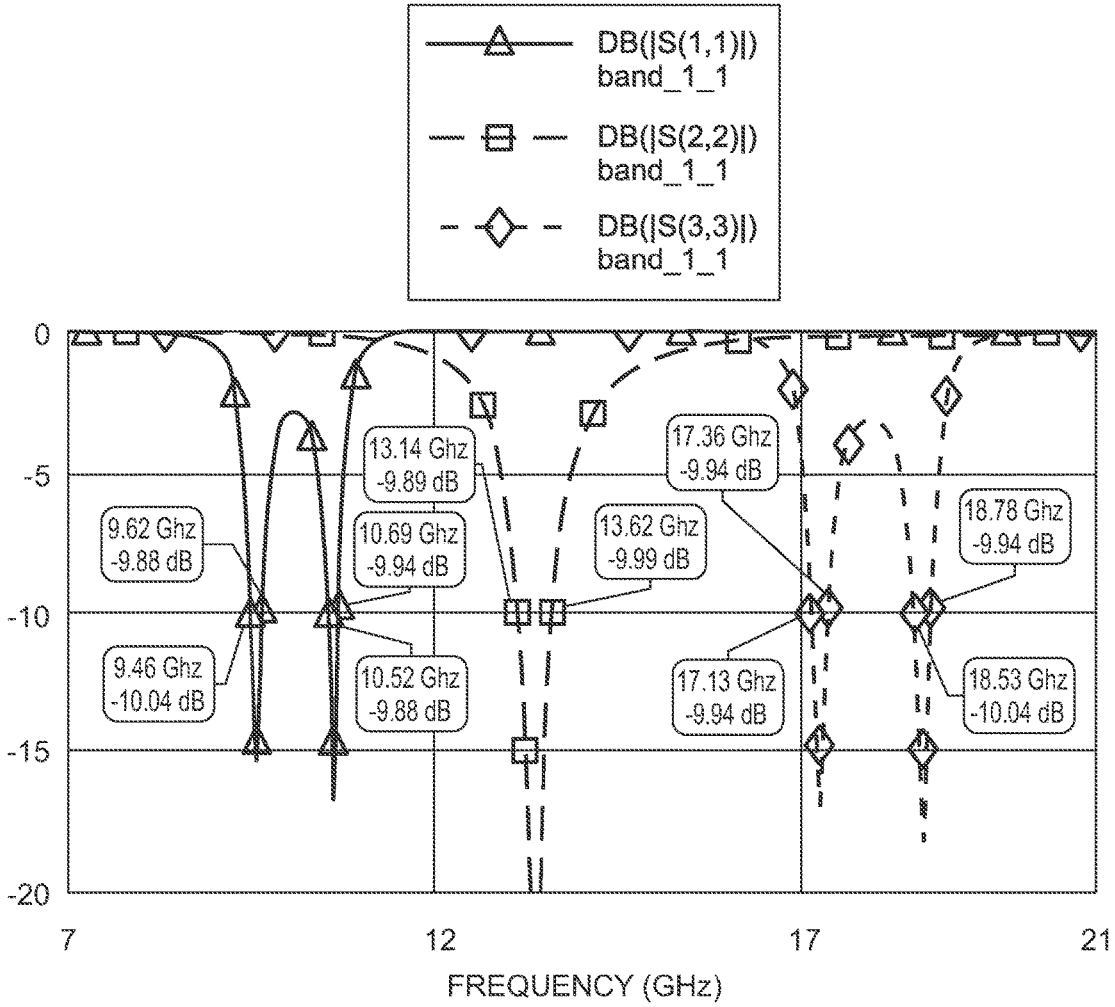
FIG. 6 illustrates the return loss versus frequency for the example of FIG. 4 where the X-band and K-band are split into two sub-bands each, as per the circuit of FIG. 5.

FIG. 4 illustrates the theoretical computed return loss for a 3-band version of the multiband antenna 200 where the operational frequencies are set at 10 GHz, 13.5 GHz, and 18 GHz. Still further, while the present invention has been described as operating at a single operational wavelength for each cavity, it is also possible to introduce circuitry to drive any pair of the excitation probes 211/212, 214/215, 217/218 at two or more closely spaced, narrow sub-bands. One sub-band may be used to transmit and the other to receive. For such and similar situations, two close sub-bands could be made using additional circuits of a filter structure (e.g., dual-band impedance equalizer), FIG. 5. For example, a cavity 240 designed to operate in the X-band may be provided with a driving circuit to provide 2 sub-bands therein, FIG. 5. Optionally, an additional cavity, such as cavity 244 designed to operate in the high Ku-band may be provided with a driving circuit to provide two sub-bands therein as well. In this regard, FIG. 6 illustrates the theoretical computed return loss for the same operational frequencies as shown in FIG. 4, but including two sub-bands in the X-band and the Ku-band as per the circuit illustrated in FIG. 5. In addition to the impedance matching networks illustrated in FIG. 5, to allow each slot to resonate at multiple sub bands, other impedance matching schemes may be employed for the feed to each annular slot using such techniques such as changing the cross section of the feed line center conductors over a given electrical length (as defined to be required electrically).

Figure 7:
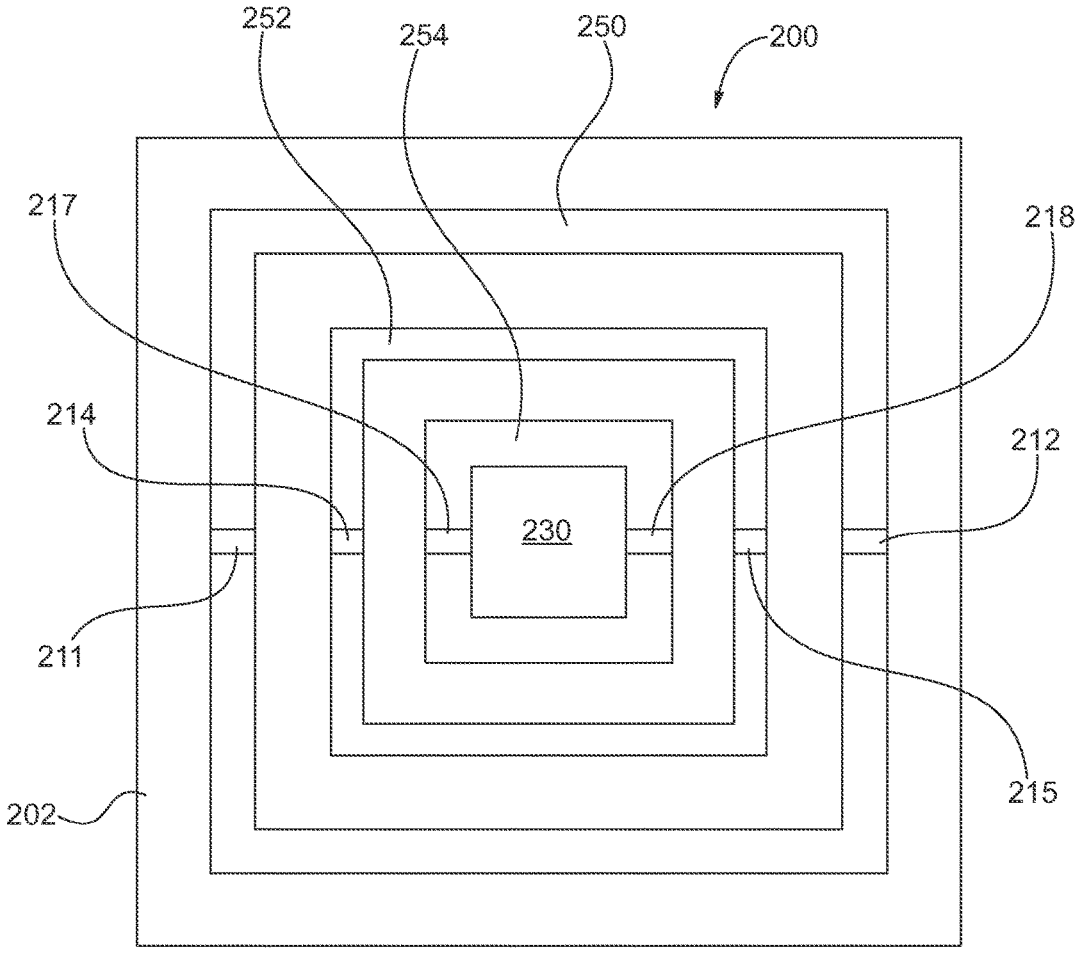
FIG. 7 schematically illustrates a top view of the multiband antenna depicted in FIGS. 2A, 2B, and 2C.

FIG. 7 illustrates a top view of the multiband antenna detailed in FIG. 2. No additional features are illustrated; however, it provides a basis of reference for the dual-polarization antenna depicted in FIG. 8.

Figure 8:
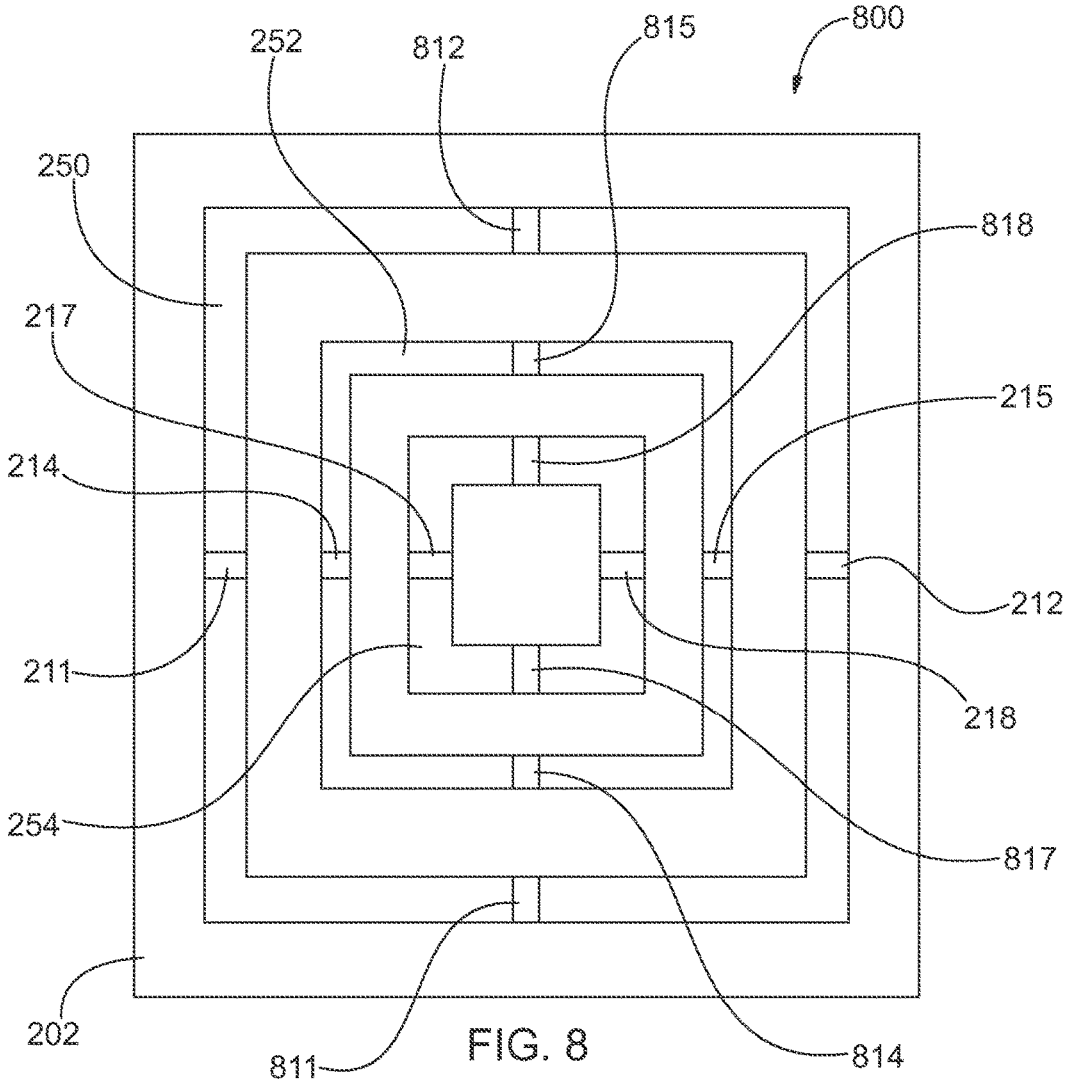
FIG. 8 schematically illustrates a top view of a dual-polarized multiband antenna in accordance with the present invention.

FIG. 8 schematically illustrates a top view of a multiband antenna that is capable of producing dual-polarized radiation, 800. In addition to the pairs of excitation probes 211/212, 214/215, 217/218 of FIG. 2, the cavities 240, 242, 244 may be driven by respective pairs of orthogonally-located excitation probes 811/812, 814/815, 817/818, a given pair of which may be disposed at opposing locations within the respective cavity 240, 242, 244. The excitation probes 811/812, 814/815, 817/818 may be located 90 degrees from the location of probes 211/212, 214/215, 217/218 whereby dual-polarized radiation may be provided. The dual-polarized antenna 800 may support linear, dual linear, slant, or circular polarization, depending on the phase difference between the various excitation probes. (The probes 811/812, 814/815, 817/818 may alternatively operate as receivers rather than transmitters.) Each pair of excitation probes 211/212, 214/215, 217/218, 811/812, 814/815, 817/818 may operate in either transmission or reception mode simultaneously with or separately from any and all other pairs of probes.

Figure 9A:
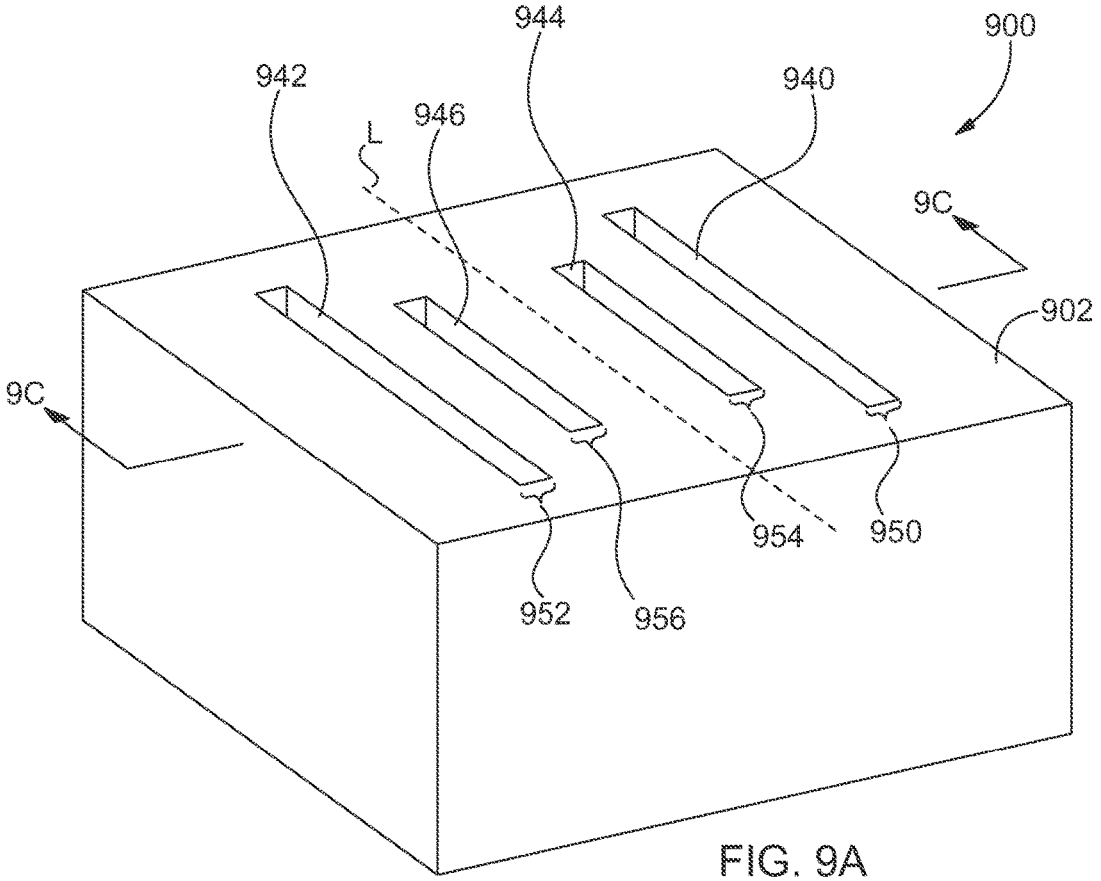
FIG. 9A schematically illustrates an isometric view of a single-polarized, multi-band antenna having a nested pairs of linear slot cavities in accordance with the present invention.
Figure 9B:
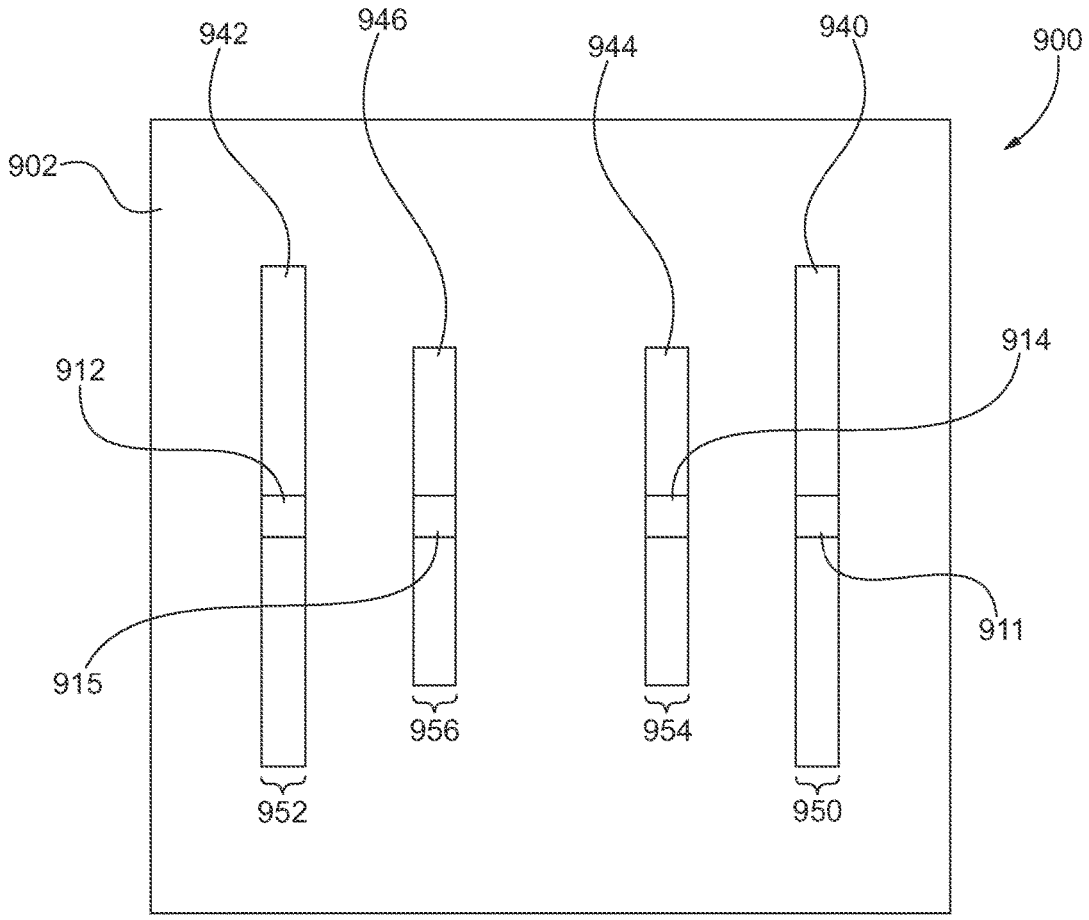
FIG. 9B schematically illustrates a top view of a single-polarized multi-band antenna of FIG. 9A.
Figure 9C:
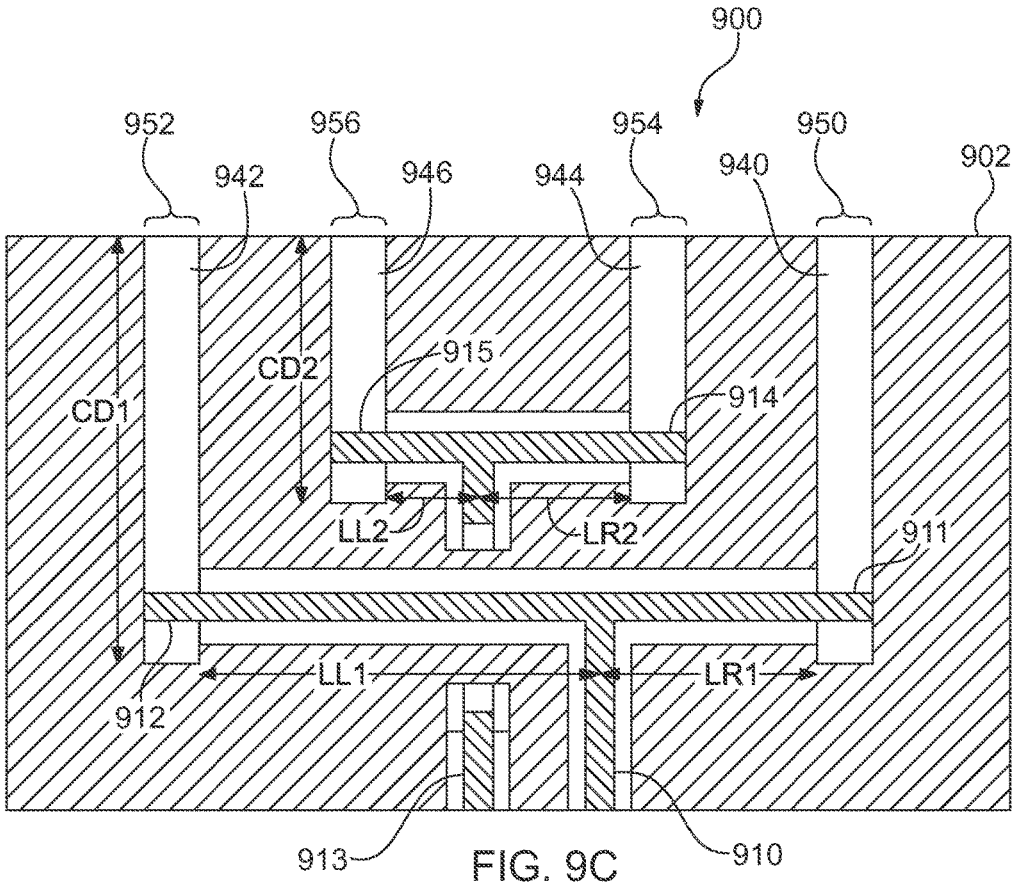
FIG. 9C schematically illustrates a side elevational, cross-sectional view with dimensioning lines of the multi-band antenna of FIG. 9A.

FIGS. 9A-9C schematically illustrate an alternative exemplary antenna configuration that includes nested pairs of linear slot cavities 940, 942, 944, 946, rather than the annular cavities 240, 242, 244 of FIGS. 2A-2C. In this regard, FIG. 9A schematically illustrates an isometric view of a single-polarized dual-band linear slot antenna, 900, having nested pairs of linear slot cavities 940, 942, 944, 946. By using these differentially-fed pairs of slot cavities 940, 942, 944, 946, the phase center can remain along the center line, L, of the slot geometry over frequency at the upper surface 902 of the antenna 900. A first pair of slot cavities 944, 946 may operate together for a given frequency, and a second pair of slot cavities 940, 942 may operate together for a lower frequency, as slot cavities 940, 942 are longer. Slot apertures 950, 952, 954, 956 in the upper surface 902 may have a rectangular shape which is generally longer than wide. The apertures 950, 952, 954, 956 of the first pair of slot cavities 944, 946 and the second pair of slot cavities 940, 942 may each be disposed symmetrically on opposing sides of the center line, L, disposed parallel to the longitudinal axes of the apertures 950, 952, 954, 956. The length of the slot apertures 950, 952, 954, 956 may be roughly half of the wavelength radiating from the slot apertures 950, 952, 954, 956. The width of the slot apertures 950, 952, 954, 956 may be 5 or more times smaller than the length of the apertures 950, 952, 954, 956. FIG. 9B schematically illustrates a top view of the antenna 900 showing excitation probes 911, 912, 914, 915 disposed within the slot cavities 940, 942, 944, 946. FIG. 9C schematically illustrates a side elevational, cross-sectional view with dimensioning lines of the multi-band antenna 900. A single-ended antenna port 910 may be provided in electrical communication with the excitation probes 911, 912, and a single-ended antenna port 913 may be provided in electrical communication with the excitation probes 914, 915. CD1 and CD2 represent the cavity depth of each slot cavity 940, 942, 944, 946. The depth may be set based on the wavelength to be used based on impedance matching, as described in FIG. 10. LR1 and LL1 represent the length of the feed for the excitation probes 911, 912, respectively. The length of the excitation probes 911, 912 may desirably differ in length by one half of the operational wavelength; that is, there may be an electrical length difference of pi (180 degrees) between the probes 911, 912. Alternatively, the phase difference may be created using a balun, a rat-race 180-degree hybrid, or some other circuit that provides a similar phase difference. LR2 and LL2 represent the length of the excitation probes 914, 915, respectively, and may desirably differ in length by one half of the operational wavelength for the operational frequency bands of those cavities. Additional pairs of linear slot cavities may be employed in further configurations of a multi-band linear slot antenna in accordance with the present invention.

Figure 10:
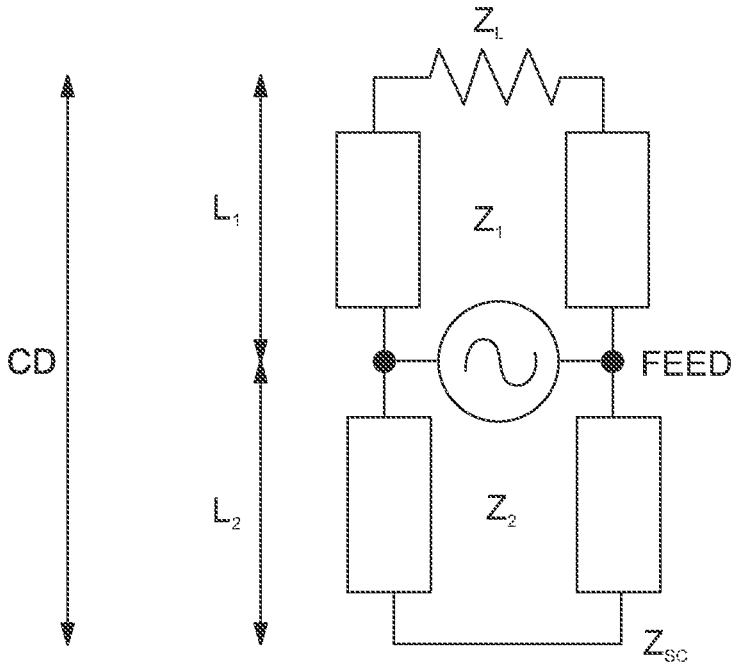
FIG. 10 illustrates a circuit model of slot impedance matching in accordance with the present invention.

FIG. 10 illustrates a circuit model of the slot impedance to illustrate the impedance matching required for energy transfer from free space to the antenna feed network. This represents the equivalent impedance of a single cavity, but similar circuit models would represent each cavity in a multi-cavity antenna. Whether an annular slot or a linear slot is used, a similar matching technique is recommended. CD is the depth of the cavity slot. That depth is divided into $L_1$, which is the length from the aperture of the cavity to the point that the feed line crosses the cavity, and $L_2$, which is the length from the feed line to the back short, which is represented by $Z_{SC}$. $Z_1$ and $Z_2$ may be different or the same based on the slot geometry, and they represent the impedance of the slot over the depths $L_1$ and $L_2$, respectively. $Z_L$ represents the antenna impedance at the aperture of the cavity. The excitation probe is represented as a voltage source in the circuit model. The combination of $Z_1$, $L_1$, $Z_2$ and $L_2$ dictate the impedance matching of the antenna. For example, $L_1$ may be approximately 0.238 wavelengths and $L_2$ may be 0.063 wavelengths at the center operational frequency of a given cavity. Zs may be 0 Ohms, $Z_1$ and $Z_2$ may be equal at 15 Ohms, and $Z_L$ may be the impedance of free space, approximately 377 Ohms.

These and other advantages of the present invention will be apparent to those skilled in the art from the foregoing specification. Accordingly, it will be recognized by those skilled in the art that changes or modifications may be made to the above-described embodiments without departing from the broad inventive concepts of the invention. It should therefore be understood that this invention is not limited to the particular embodiments described herein, but is intended to include all changes and modifications that are within the scope and spirit of the invention as set forth in the claims.

What is claimed is:

1. A multiband antenna for operation at two or more selected wavelengths, the multiband antenna comprising:

a first cavity having first sidewalls disposed within the antenna, the first sidewalls extending upward from the interior of the antenna to an upper surface of the antenna such that the first sidewalls provide a first aperture having an annular shape in the upper surface;

a second cavity having second sidewalls disposed within the antenna, the second sidewalls extending upward from the interior of the antenna to the upper surface of the antenna such that the second sidewalls provide a second aperture having an annular shape in the upper surface, the second aperture disposed internally to the first aperture within the upper surface;

a first pair of excitation probes disposed within the first cavity; and a second pair of excitation probes disposed within the second cavity;

wherein each of the first and second cavities has a cross-sectional shape in a plane perpendicular to the upper surface which is "L"-shaped.

2. The multiband antenna according to claim 1, wherein each of the first pair of excitation probes has a length associated therewith, and a difference between the lengths of the first pair of excitation probes is one half of a first selected operational wavelength of the first cavity.

3. The multiband antenna according to claim 1, wherein the antenna comprises an electrically conductive material in which the first and second cavities are disposed.

4. The multiband antenna according to claim 1, wherein the first cavity extends from the upper surface into the antenna to a depth which is greater than that of the second cavity.

5. The multiband antenna according to claim 1, comprising a first coaxial feedline disposed within the antenna and electrically connected to the first pair of excitation probes.

6. The multiband antenna according to claim 1, wherein each of the second pair of excitation probes has a length associated therewith, and a difference between the lengths of the second pair of excitation probes is one half of a second selected operational wavelength of the second cavity.

7. The multiband antenna according to claim 1, comprising a second coaxial feedline disposed within the antenna and electrically connected to the second pair of excitation probes.

8. The multiband antenna according to claim 1, wherein the first aperture has a generally rectangular shape.

9. The multiband antenna according to claim 1, wherein the first aperture has a generally circular shape.

10. The multiband antenna according to claim 1, wherein the first and second apertures are co-centered with one another in the upper surface.

11. The multiband antenna according to claim 1, wherein the volume of the antenna disposed internally to the second aperture has a generally cubic shape.

12. The multiband antenna according to claim 1, comprising a circuit for electrically driving the first pair of excitation probes to provide a pair of sub-bands proximate the operational wavelength of the first cavity.

13. The multiband antenna according to claim 1, wherein the depth of the first cavity is one quarter of a first operational wavelength of the first cavity.

14. The multiband antenna according to claim 1, wherein the depth of the second cavity is one quarter of a second operational wavelength of the second cavity.

15. The multiband antenna according to claim 1, wherein the probes of the first pair of excitation probes are disposed on opposing sides of the first cavity.

16. The multiband antenna according to claim 1, wherein the probes of the first pair of excitation probes are disposed along a line that extends through the center of the antenna.

17. The multiband antenna according to claim 16, comprising a third pair of probes disposed within the first cavity and disposed along a line that extends through the center of the antenna, wherein the lines along which the first and third pair of probes are disposed are oriented orthogonally relative to one another.

18. The multiband antenna according to claim 1, comprising a third pair of probes disposed within the first cavity.

* * * * *